US005681106A

United States Patent [19]

Coultas et al.

[11] Patent Number: 5,681,106

[45] Date of Patent: Oct. 28, 1997

[54] FLEXIBLE ADJUSTABLE LANTERN ADAPTER FOR HAND HELD FLASHLIGHTS

[76] Inventors: Cecilia J. Coultas; Jamie A. Coultas, both of 7211 Las Brisas Dr., Houston, Tex. 77083

[21] Appl. No.: 674,501

[22] Filed: Jul. 2, 1996

Related U.S. Application Data

[63] Continuation-in-part of Ser. No. 424,720, Apr. 18, 1995, abandoned.

[51] Int. Cl.[6] ..... F21L 15/08

[52] U.S. Cl. ..... 362/190; 362/396; 362/451

[58] Field of Search ..... 362/396, 186, 362/190, 191, 451, 306, 407; 248/690, 692, 693, 205.2, 339, 328

[56] References Cited

U.S. PATENT DOCUMENTS 4,783,725 11/1988 Schaller et al. .

5,077,644 12/1991 Schaller et al. .

5,210,656 5/1993 Williamson .

5,222,000 6/1993 Adler .

5,337,179 8/1994 Hodges .

*Primary Examiner*—Ira S. Lazarus

*Assistant Examiner*—Sara Sachie Raab

*Attorney, Agent, or Firm*—Wendy K. Buskop; Chamberlain, Hrdlicka, White, Williams & Martin

[57] ABSTRACT

In one embodiment of the present invention, there is provided an apparatus for suspending a light source such as a flashlight and amplifying the light emanating from the flashlight. The apparatus comprises a plate having a longitudinal axis, a top surface and a bottom surface. There is a means for removably retaining a fight source and a hanging means. A method for illuminating a space using the described apparatus is also provided.

14 Claims, 3 Drawing Sheets

FLEXIBLE ADJUSTABLE LANTERN ADAPTER FOR HAND HELD FLASHLIGHTS

This is a continuation-in-part application based on application Ser. No. 08/424,720 filed on Apr. 18, 1995, now abandoned.

BACKGROUND OF THE INVENTION

This invention relates generally to fight reflecting devices, and particularly to lightweight, flexible and adjustable reflectors for use with hand held flashlights.

Internal reflectors are an integral part of virtually all flashlights. The reflector is the common method by which the light generated by the bulb in the flashlight is directed from the flashlight to a general or specific area. Traditionally, a hand held flashlight is held by the user and the light emitted by the bulb in the hand held flashlight is directed at the object(s) to be illuminated. The major problem with the traditional use of hand held flashlights is that they must be held, by one or both hands, to illuminate the desired object (s), thus allowing the user only one, and possibly no, hand with which to work. In particular, any activity that requires two hands requires the user to hold the hand held flashlight in his mouth, under his arm, have another person hold the hand held flashlight, etc., or lay the hand held flashlight down on a convenient, and stable, surface, should one be present. Devices currently exist to allow one to attach a hand held flashlight to one's head, or grip the hand held flashlight between one's teeth, but these devices include no means of reflecting the light generated by the hand held flashlight.

U.S. Pat. No. 4,783,725 discloses a flashlight with an internal reflector that reflects the light generated by the bulb in the flashlight in a direction 90 degrees to the longitudinal axis of the flashlight, but this device suffers the shortcomings described above for hand held flashlights.

U.S. Pat. No. 5,077,644 discloses a flashlight that has dual light sources, both of which are arranged to reflect the light generated by the bulbs in the flashlight in fixed directions other than in line with the longitudinal axis of the flashlight, but this device suffers the shortcomings described above for hand held flashlights.

U.S. Pat. No. 5,337,179 discloses a flexible controllable optical surface that can be rolled up and unrolled, but this device has no means of attachment to a light source, nor can the reflective surface be easily adjusted to different multiple angles of incidence to the light source.

U.S. Pat. No. 5,210,656 discloses an adjustable reflector, but this device has no means of attachment to a light source, includes multiple rigid panels of specific geometric shapes, and is designed primarily as a flash reflector for photographic purposes.

U.S. Pat. No. 5,222,000 discloses a flexible reflector, but this device is not designed specifically for use with a light source, has no means of attachment to a light source, and incorporates flexibility primarily as a means to distort reflected images for amusement purposes.

SUMMARY OF THE INVENTION

In one embodiment of the present invention, there is provided an apparatus for suspending a light source such as a flashlight and reflecting the light emanating from the flashlight. The apparatus comprises a plate having a longitudinal axis, a top surface and a bottom surface. There is a means for removably retaining a light source and a hanging means.

The hanging means has a plurality of strings attached thereto. The hanging means has a first end and a second end. The second end of the hanging means is attached to the means for removably retaining a light source. The plurality of strings slidably intersect the plate Preferably, there are at least two strings. The preferred embodiment uses three strings. The strings can be made of a flexible material such as nylon, cotton, polypropylene, pliable metal, elastic cord, or a combination of these materials. The hanging means can also have a hook attached to the first end. The hook makes it easier to hang the apparatus inside a tent or underneath a car hood or a boat cabin. The light source can be a commercially available, portable, battery operated flashlight.

In another embodiment of the present invention, there is provided a method for illuminating a space. The method comprises providing an apparatus as described above. The means for removably retaining a light source is positioned so that the light is directed towards the bottom surface of the plate. The light source is positioned in the means for removably retaining a light source and the light source is activated.

It is an object of this invention to provide a method to use a hand held flashlight in a hands free mode.

It is another object of this invention to provide a method for using a hand held flashlight as a lamp or lantern.

It is another object of this invention in to provide a safe method to light the interior of a tent.

It is another object of this invention is to provide a method for safe lighting in emergency situation's such as home power outages.

It is yet another object of this invention is to provide a lightweight, portable lantern or lamp that can be easily stored in a backpack requiring only minimal space and adding minimal weight.

It is another object of this invention is to provide a method for lighting the engine, interior, or trunk compartment of a vehicle in emergency situations.

Other objectives and advantages of the invention shall become apparent from the following description of the invention.

DETAILED DESCRIPTION OF THE PREFERRED EMBODIMENT

Figure 1:
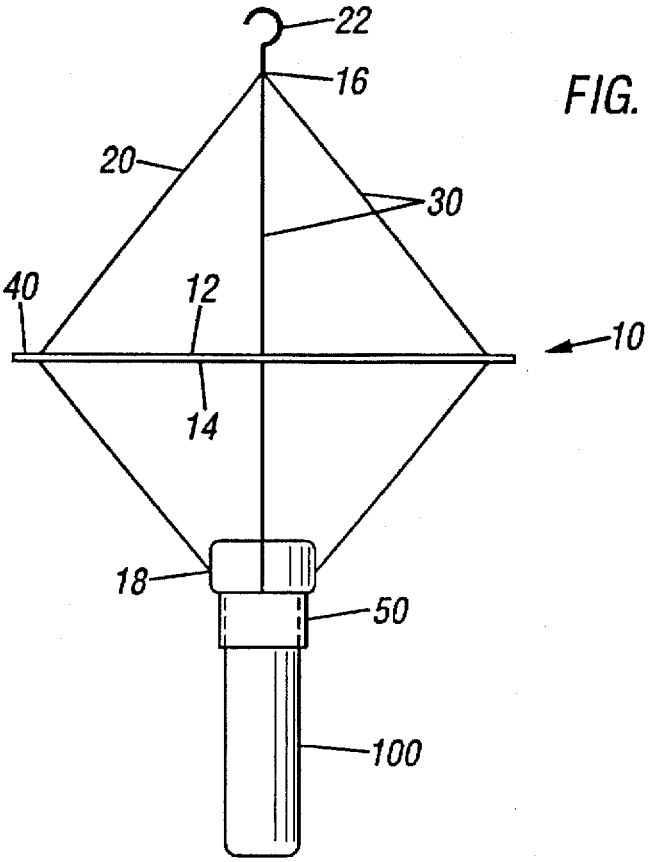
FIG. 1 is a perspective view of the invention.

In one embodiment of the present invention, there is provided an apparatus 10 for suspending a light source such as a flashlight 100 and reflecting the light emanating from the flashlight. The apparatus comprises a plate 40 having a longitudinal axis, a top surface 12 and a bottom surface 14. There is a means 50 for removably retaining a light source and a hanging means 20.

The hanging means 20 has a plurality of strings 30 attached thereto. The hanging means 20 has a first end 16 and a second end 18. The second end 18 of the hanging means 20 is attached to the means 50 for removably retaining a light source. The plurality of strings 30 slidably intersect the plate 40. Preferably, there are at least two strings. The preferred embodiment uses three strings. The strings can be made of a flexible material such as nylon, cotton, polypropylene, pliable metal or a combination of these materials. The hanging means 20 can also have a hook 22 attached to the first end. The hook 22 makes it easier to hang the apparatus 10 inside a tent or underneath a car hood. The light source can be a commercially available, portable, battery operated flashlight.

The plate 40 has several preferred features. The plate 40 is flexible and substantially flat like a coin. Preferably, the bottom surface is smooth so that the light will be deflected evenly. The bottom surface of the plate 40 preferably faces the means 50 for removably retaining a light source. The bottom surface of the plate 40 can be light in color. The color does not have to be white however, white gives the greatest mount of reflectivity. The plate 40 can be made of polystyrene, polyethylene, or any similar type of polymer, stainless steel or aluminum. The plate 40 can be round as shown, triangular, square, or rectangular in shape. The top surface 12 of the plate 40 can be covered with a mirror-like material, or metalized polyester film such as Mylar® so that the apparatus can be used as a mirror. The plate 40 can also be conical so that the bottom surface 14 is concave.

Preferably, the means 50 for removably retaining a light source comprises a Velcro® strip. The means 50 for removably retaining a light source could also be a rubber band, elastic, a string that ties around the light source or a hook 22 attached to a loop to hold the light in place. These types of materials allow for the means 50 for removably retaining a light source to be adjusted to closely receive a flashlight.

In another embodiment of the present invention, there is provided a method for illuminating a space. The method comprises providing an apparatus 10 as described above. The means 50 for removably retaining a light source is positioned so that the light is directed towards the bottom surface of the plate 40. The light source is positioned in the means 50 for removably retaining a light source and the light source is activated.

Referring now to the drawings in detail, there is illustrated in FIG. 1 an apparatus 10 that can be used with a hand held flashlight. A commercially available hand held flashlight 100 can be used with the apparatus 10.

The apparatus includes a hanging means 20 having a plurality of strings 30 attached thereto, a plate 40, and an means 50 for removably retaining a light source into which a hand held flashlight can be placed. The plurality of strings 30 are immovably fastened to the hanging means 20 and the means 50 for removably retaining a light source so as to create fixed points. The plurality of strings 30 are fastened to the plate 40 so as to allow the plate 40 to be moved and positioned along the length of each of the plurality of strings 30 independently.

As seen most clearly in FIG. 1 the apparatus in shown as it would be used as an ordinary overhead type lantern or lamp. Used in this manner, the apparatus 10 has the plate 40 positioned perpendicular to the longitudinal centerline axis of the bulb of the hand held flashlight 100 and will provide maximum reflected light over the broadest area, such as the inside of a tent or in a picnic area. The position of the plate 40 on the flexible connecting members 30 is the same relative to the means 50 for removably retaining a light source and the hanging means 20. The distance of the plate 40 from the means 50 for removably retaining a light source is the same along each of the plurality of strings 30, and the distance of the plate 40 from the hanging means 20 is the same along each of the plurality of strings 30. The position of the plate 40 can be located equidistant from the means 50 for removably retaining a light source and the hanging means 20, at the discretion of the user.

Figure 2:
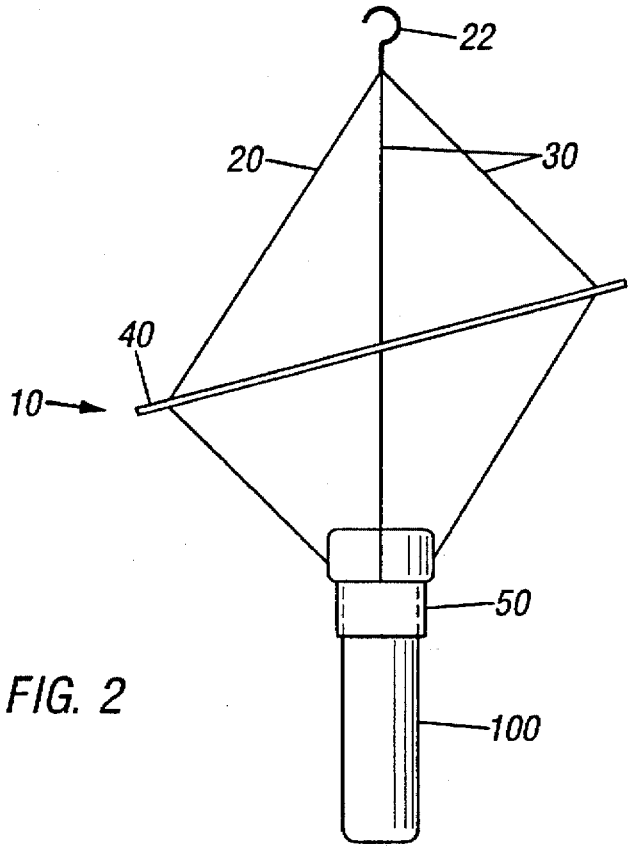
FIG. 2 is a perspective view of the invention showing how the components may be arranged if it is desired to reflect the light from the hand held flashlight at a 90 degree fight angle or any oblique angle, between 91 degrees and 179 degrees to the longitudinal axis of the bulb of the hand held flashlight.
Figure 3:
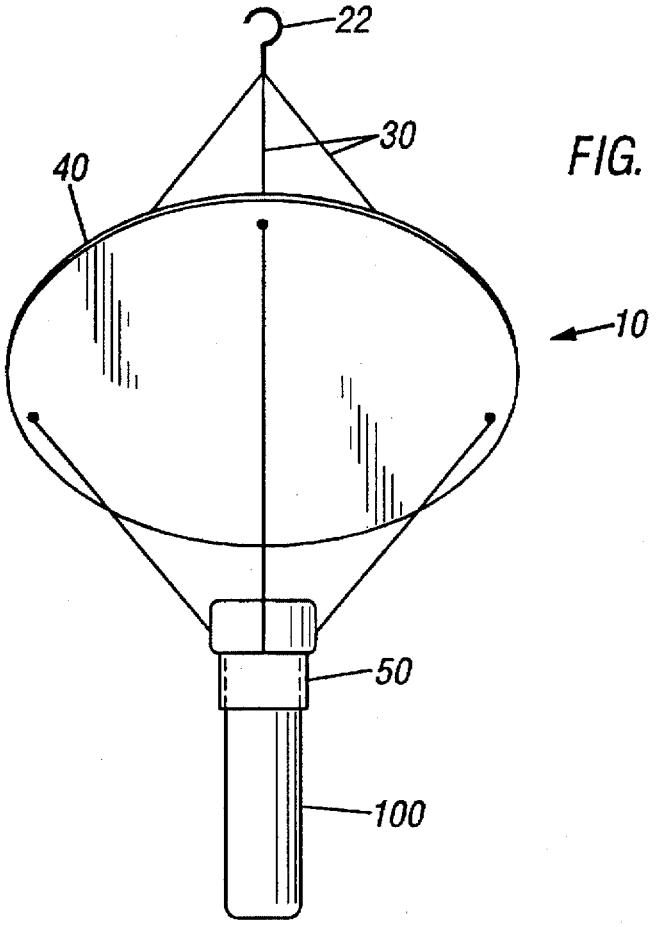
FIG. 3 is another side view of this invention showing how the plate may be positioned to direct the reflected light through the full 360 degrees of horizontal area without removing and reattaching the apparatus from what it is attached to, or without rotating the entire apparatus.
Figure 4:
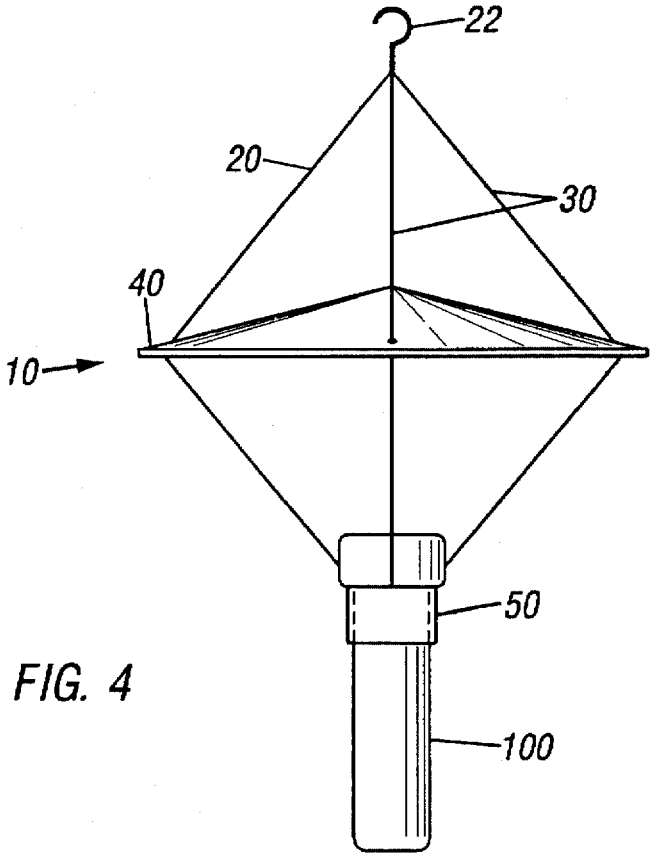
FIG. 4 is a side view of the apparatus 10 wherein the plate 40 is conical in shape rather than flat.
Figure 5:
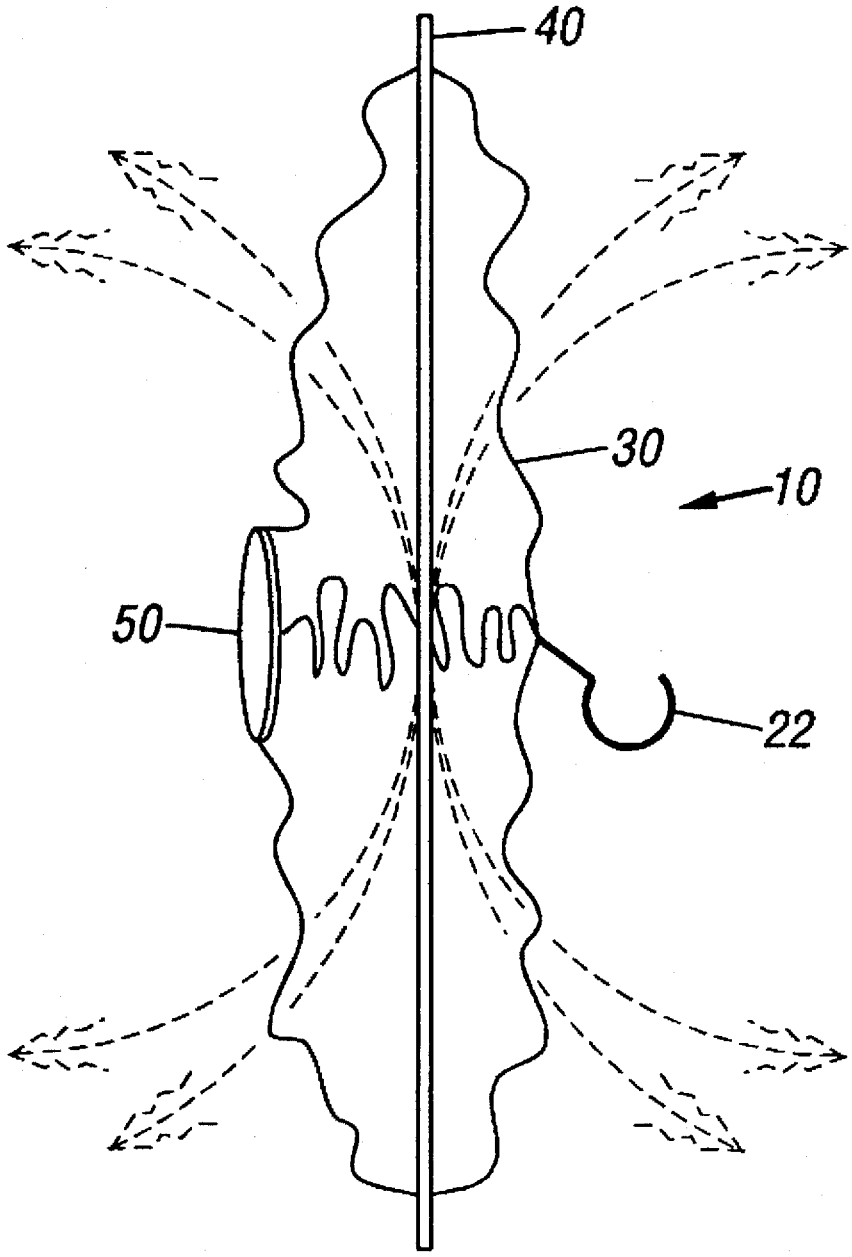
FIG. 5 is a side view of this invention showing how, due to the flexibility of the apparatus, it may be conveniently stored, such as in a backpack, for transport.

As seen most clearly in FIG. 2 and FIG. 3, the apparatus 10 has the plate 40 positioned at an oblique angle to the longitudinal centerline of the hand held flashlight 100. FIG. 2 and FIG. 3 most clearly demonstrate the ability of the user to move the plate 40 independently along each of the plurality of strings 30. As shown in FIG. 2, the apparatus would be used to direct the reflected light to a specific area along the longitudinal axis of the hanging means 20. As shown in FIG. 3, the apparatus would be used to direct the reflected light to a specific area perpendicular to the longitudinal axis of the hanging means 20. Used in this manner, the apparatus 10 and hand held flashlight combination will provide reflected light to a particular location, such as to tie ones shoes, or locate small items in a tent, or to direct light to a specific area in the engine compartment of a vehicle.

FIG. 6 shows that the apparatus 10 can be bent to minimize space requirements when packed. Additionally, FIG. 6 shows that the flexible connecting members 30 will allow the hanging means 20 and the means 50 for removably retaining a light source to come into intimate contact with the plate 40 to enhance packability. This will allow the apparatus to be easily stowed in a backpack or vehicle trunk and be transported without fear of breakage.

In view of the foregoing, it should be apparent that there is provided in accordance with this invention a unique external light reflecting device for hand held flashlights that overcomes many of the problems and shortfalls of the existing prior art in this field, and provides substantial value to the use of hand held flashlights.

While only preferred embodiments of the invention have been illustrated and described herein, it is to be understood that many modifications may be made therein without departing from the scope of the invention as set forth in the appended claims.

What is claimed is:

1. An apparatus comprising:

a plate having a longitudinal axis, a top surface and a bottom surface;

a means for removably retaining a light source;

a hanging means having a plurality of strings attached thereto, wherein said hanging means has a first end and a second end attached to said means for removably retaining a light source, wherein said plurality of strings slidably intersect said plate;

wherein the bottom surface of the plate faces the means for removably retaining a light source so that a light beam from a light source is directed toward the bottom surface of the plate.

2. An apparatus as in claim 1, wherein the bottom surface of the plate is light in color.

3. An apparatus as in claim 1, wherein the plate is round in shape.

4. An apparatus as in claim 1, wherein the plate is substantially flat.

5. An apparatus comprising:

a plate having a longitudinal axis, a top surface and a bottom surface:

a means for removably retaining a light source; and a hanging means having a plurality of strings attached thereto, wherein said hanging means has a first end and a second end attached to said means for removably retaining a light source, wherein said plurality of strings slidably intersect said plate;

wherein the bottom surface of the plate faces the means for removably retaining a light source;

wherein the bottom surface of the plate is light in color, wherein the plate is round in shape, wherein the plate is substantially flat, wherein the plate is flexible.

6. An apparatus as in claim 5, wherein the top surface of the plate is covered with a mirror-like material.

7. An apparatus as in claim 5, further comprising a portable, battery operated flash-fight.

8. An apparatus as in claim 5, wherein the plate is conical, wherein the bottom surface is concave.

9. An apparatus as in claim 5, wherein the means for removably retaining a light source comprises a Velcro® strip.

10. An apparatus as in claim 5, wherein the means for removably retaining a light source can be adjusted to closely receive a flash light.

11. An apparatus as in claim 5, wherein said hanging means further comprises a hook.

12. An apparatus as in claim 5, wherein the plurality of strings comprises at least two strings.

13. An apparatus comprising:

a plate having a longitudinal axis, a top surface and a bottom surface;

a means for removably retaining a light source; and a hanging means having a plurality of strings attached thereto, wherein said hanging means has a first end and a second end attached to said means for removably retaining a light source, wherein said plurality of strings slidably intersect said plate; and a light source attached to said means for removably retaining a light source wherein the bottom surface of the plate faces the means for removably retaining a light source so that a light beam from a light source is directed toward the bottom surface of the plate.

14. A method for deflecting light from a light source, said method comprising:

providing a plate having a longitudinal axis, a top surface and a bottom surface, wherein said bottom surface is light in color and a means for removably retaining a light source;

providing a hanging means having a plurality of strings attached thereto, wherein said hanging means has a first end and a second end attached to said means for removably retaining a light source, wherein said plurality of strings slidably intersect said plate;

positioning a means for removably retaining a light source so that the light is directed towards the bottom surface of the plate; and positioning a light source in the means for removably retaining a light source; and activating the light source.

* * * * *